United States Patent [19]

Wu

[11] 4,028,832

[45] June 14, 1977

[54] CORNER HOOK FRAME

[76] Inventor: Celia Wu, 295 W. 11th St., New York, N.Y. 10014

[22] Filed: May 24, 1976

[21] Appl. No.: 689,500

[52] U.S. Cl. ..... 40/155; 248/490
[51] Int. Cl.[2] ..... G09F 1/12
[58] Field of Search ..... 40/153, 152, 155, 152.1, 40/156; 248/488, 490

[56] References Cited

UNITED STATES PATENTS

| | | | |
|---|---|---|---|
| 412,953 | 10/1889 | Gale | 40/152.1 |
| 700,548 | 5/1902 | Nelson | 40/153 |
| 3,676,944 | 7/1972 | Eubank | 40/155 |
| 3,798,815 | 3/1974 | Ward | 40/156 |
| 3,958,352 | 5/1976 | Eubank | 40/155 |

FOREIGN PATENTS OR APPLICATIONS

| | | | |
|---|---|---|---|
| 211,636 | 11/1957 | Australia | 40/152.1 |

*Primary Examiner*—G.E. McNeill
*Assistant Examiner*—Wenceslao J. Contreras
*Attorney, Agent, or Firm*—Robert D. Farkas

[57] ABSTRACT

A corner hook frame assembly used for detachably securing a picture to a board member includes four hooked shaped anchoring members, wherein each anchoring member detachably secures onto one of the corners of the combination of the picture and board member. A spring member is detachably secured to each anchoring member. A closed loop member is detachably secured to each spring member, wherein the size of the closed loop member can be varied thereby exerting tension on each of the spring members.

3 Claims, 3 Drawing Figures

CORNER HOOK FRAME

BACKGROUND OF THE INVENTION

A number of United States patents relate to support means for displaying various articles. U.S. Pat. No. 2,826,384 to Brown relates to a support assembly for hanging plates. U.S. Pat. No. 2,992,464 to Muhlemann relates to a bracket assembly for mounting a picture. U.S. Pat. No. 3,256,630 to Spector relates to a supporting means for display panels, wherein corner brackets are employed these aforementioned patents are non-applicable to my present instant invention.

SUMMARY OF THE INVENTION

My present invention relates to a unique and novel means for removably securing a picture to a support panel.

An object of my present invention is to provide a unique and novel support assembly for securing a picture to a panel, wherein the support assembly is adjustable thereby being able to accommodate different size pictures.

Briefly, my present invention comprises four hook shaped anchoring members, wherein each anchoring member detachably secures onto one of the corners of the combination of the picture and board member. A spring member is detachably secured to each anchoring member. A closed loop member is detachably secured to each spring member, wherein the size of the closed loop member can be varied thereby exerting tension on each of the spring members.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
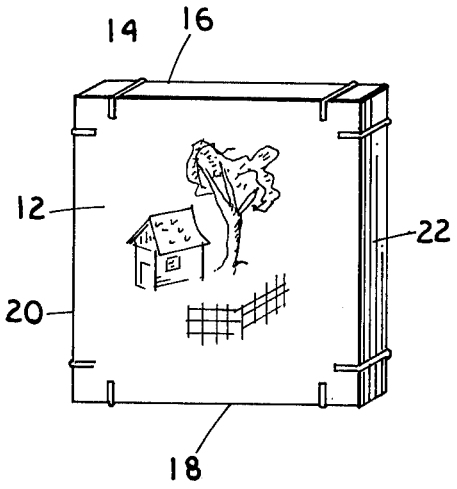
FIG. 1 illustrates a front view of a corner hook frame support assembly for securing a picture to a support board.
Figure 2:
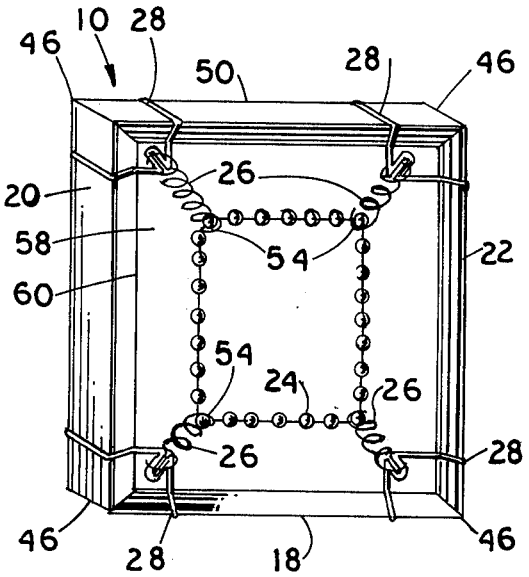
FIG. 2 illustrates a rear view of the corner hook frame assembly.

Turning now descriptively to the drawings, in which similar reference characters denote similar elements throughout the several views, FIGS. 1–2 show a corner hook frame support assembly 10 adapted to removably secure a picture 12 or poster to a rectangularly shaped panel 14 having a pair of ends 16, 18 and sides 20, 22. The assembly 10 generally comprises a chain member 24, a plurality of spring members 26 and a plurality of anchoring hook members 28.

Figure 3:
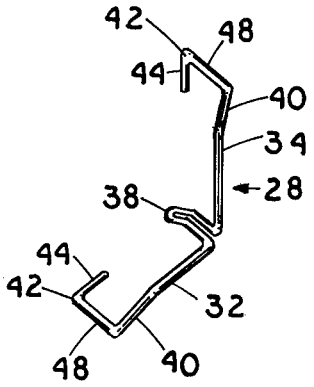
FIG. 3 illustrates a perspective view of a corner anchoring member.

Each anchoring member 28 as depicted in FIG. 3 comprises a large center V-shaped center section 30 having a pair of legs 32, 34 disposed outwardly from a common juncture 36 of the legs 32, 34. A hook-shaped section 38 is affixed to section 30 at juncture 36, wherein section 38 extends upwardly from the plane of section 30 and is disposed inwardly over the space defined between the legs 32, 34 of section 30. An elongated intermediate section 40 communicates with the free end of each leg 32, 34, wherein each section 40 extends obtusely upwardly from each free end of each leg 32, 34. An L-shaped section 42 is affixed perpendicularly to the free end of each section 40, wherein the outer free leg 44 of each section 42 extends downwardly towards the plane of section 30. Each combination of sections 40, 42 is defined by a common plane which also passes through one of the legs 32, 34. One anchoring hook member 28 is detachably secured onto one of the corners 46 of the panel 14, wherein the inner leg 48 of each section 40 engages the peripheral edge 50 of the board 14 and the outer leg 44 of each section 40 engages the front face of the picture 12 thereby securing the picture 12 to the panel 14. The legs 32, 34 of each member 28 engage the rear surface of board 14. A spring member 26 is secured to each section 38 of each member 28, wherein the free end of each spring member 26 is formed in the shape of an eyelet 54. An elongated chain member 24 is passed through each eyelet 54 of the four spring members 26. The chain member 24 is drawn taut and tied thereby causing the spring members 26 to undergo tension and secure each member 28 firmly to the combination of the picture 12 and panel 14. The panel 14 has a central recessed area 58 therein, wherein the outer edges 60 of area 58 are beveled outwardly to the peripheral edge of panel 14. The intermediate sections 40 of each member 28 engage against these beveled outer edges 60.

FIG. 4 illustrates a second embodiment of the corner hook 80 which includes two identical portions 82, 84. Each portion 82, 84 comprises an elongated center section 86, wherein an eyelet section 88 is affixed to one end of portion 86. An outwardly turned flange 90 is affixed to the outer end of section 88. To the other end of portion 86 is affixed perpendicularly an L-shaped end section 92. In use, the eyelet sections 88 are laid on top of each other such that the center sections 86 of portions 82, 84 form a V-shape configuration.

Having thus described the invention, what I claim as new and desire to secure by Letters Patent of the United States is:

1. A corner hook frame assembly for detachably securing a picture to a panel member, which comprises:

a. a plurality of hook shaped anchoring members, each said anchoring member including a pair of legs adapted to be removably secured onto one corner of a combination of said panel and said picture, each said anchoring member including a large V-shaped section having a common juncture between said legs, an intermediate section integrally joined at an obtuse angle to an outer free end of each said leg, an L-shaped section perpendicularily joined to an outer free end of each said intermediate section, and a hook shaped section integrally joined to each said juncture of each said V-shaped section;

b. a plurality of spring members, one said spring member detachably secured to one said hook shaped section of one of said anchoring members; and c. a closed loop member, said closed looped member removably communicating with each said spring member causing a tension to be placed on each said spring member.

2. An assembly according to claim 1, wherein each said spring member further comprises an eyelet section affixed to one end of each said spring member, each said eyelet receiving said closed looped member therethrough.

3. An assembly according to claim 1, wherein said closed loop member is an elongated chain member, wherein the ends of said chain member are tied together.

* * * * *